US007014271B2

(12) United States Patent
Burger et al.

(10) Patent No.: US 7,014,271 B2
(45) Date of Patent: Mar. 21, 2006

(54) APPARATUS FOR DETECTING THE STATE OF ROTATION OF CUTTING ROLLERS OF A SHIELD TUNNELING MACHINE

(75) Inventors: Werner Burger, Schwanau (DE); Bernhard Ihle, Bruchsal (DE); Manfred Messing, Bruchsal (DE); Thorsten Köbele, Riegel (DE)

(73) Assignees: Herrenknecht AG, Schwanau (DE); VMT GmbH, Bruchsal (DE)

( * ) Notice: Subject to any disclaimer, the term of this patent is extended or adjusted under 35 U.S.C. 154(b) by 0 days.

(21) Appl. No.: 10/900,493

(22) Filed: Jul. 28, 2004

(65) Prior Publication Data

US 2005/0023882 A1 Feb. 3, 2005

(30) Foreign Application Priority Data

Jul. 28, 2003 (EP) ..... 03017040

(51) Int. Cl.
*E21C 37/26* (2006.01)

(52) U.S. Cl. ..... 299/1.05; 299/1.8; 299/110

(58) Field of Classification Search ..... 299/1.8, 299/1.4, 1.05, 110
See application file for complete search history.

(56) References Cited

U.S. PATENT DOCUMENTS

| | | | | |
|---|---|---|---|---|
| 3,591,235 A | * | 7/1971 | Addison | 299/1.2 |
| 4,181,360 A | * | 1/1980 | Wilson | 299/1.2 |
| 4,189,183 A | * | 2/1980 | Borowski | 299/1.6 |
| 4,655,082 A | * | 4/1987 | Peterson | 73/594 |
| 5,106,163 A | | 4/1992 | Fujiwara et al. | 299/1.3 |

FOREIGN PATENT DOCUMENTS

| | | | |
|---|---|---|---|
| JP | 06167193 | | 6/1994 |
| JP | 09228778 | | 9/1997 |
| WO | WO96/19639 | * | 6/1996 |

OTHER PUBLICATIONS

First page of the European Search Report issued in related European application No. EP 03 01 7040.

* cited by examiner

*Primary Examiner*—John Kreck
(74) *Attorney, Agent, or Firm*—Baker & Daniels LLP

(57) ABSTRACT

An arrangement for detecting the state of rotation of cutting rollers (2) of a shield tunneling machine has at least one cutting roller (2) comprising a generator unit (12) that generates electrical energy when the respective cutting roller (2) is rotating, a signal-generating unit (16) connected to the generator unit (12), and an antenna unit (17) connected to the signal-generating unit (16). The signal generating unit (16) serves to generate transmission signals characteristic of the state of rotation of the respective cutting roller (2). An antenna (20) of the antenna unit (17) is disposed over at least one outer circumferential portion of the respective cutting roller (2) and is equipped for the wireless transmission of the transmission signals. The arrangement further comprises a receiving unit equipped to receive the transmission signals and interpret them regarding the state of rotation of the respective cutting roller (2). In this fashion, given the autonomous nature of the energy supply to the signal generating units (16) disposed in the cutting rollers (2), the state of rotation of the cutting rollers (2) can be monitored wirelessly from, for example, a control booth of the shield tunneling machine.

8 Claims, 7 Drawing Sheets

APPARATUS FOR DETECTING THE STATE OF ROTATION OF CUTTING ROLLERS OF A SHIELD TUNNELING MACHINE

The invention concerns an arrangement for detecting the state of rotation of cutting rollers of a shield tunneling machine.

Shield tunneling machines equipped with cutting rollers for excavation, especially in rock, are subject to the problem that the cutting rollers are exposed to extreme stresses and under some circumstances stop rotating before the end of the typical industrial service life. If the stoppage of a cutting roller is not detected promptly, there is a high risk that the portion of the roller in contact with the heading face will be damaged and require time- and labor-intensive repair work.

The object of the invention is to provide an arrangement by means of which the state of rotation of cutting rollers of a shield tunneling machine can be detected reliably and in a comparatively simple manner.

This object is achieved according to the invention by means of an arrangement for detecting the state of rotation of cutting rollers of a shield tunneling machine having at least one cutting roller, said arrangement comprising a generator unit that generates electrical energy when the respective cutting roller is rotating, a signal-generating unit connected to the generator unit, and an antenna unit connected to the signal-generating unit, wherein transmission signals characteristic of the state of rotation of the respective cutting roller can be generated by means of the signal-generating unit and wherein an antenna of the antenna unit is disposed over at least one outer circumferential portion of the respective cutting roller and is equipped for the wireless transmission of said transmission signals, and with a receiving unit equipped to receive and interpret the transmission signals regarding the state of rotation of the respective cutting roller.

The fact that the energy supply to the signal generating unit is autonomous and lasts indefinitely, since the generator unit is basically operative whenever the cutting roller is rotating, enables the transmission signals to be generated precisely when the cutting roller concerned is rotating, without any need to depend on the environment for energy. Thus, as the transmission signals characteristic of each cutting roller are transmitted wirelessly and interpreted, the cutting rollers for which no transmission signals can be detected are identified as not rotating and therefore defective.

In an improvement, the antenna is advantageously disposed in a groove recessed circumferentially into a base body of the cutting roller to one side of a cutting body and is embedded in a mechanically and thermally resistant, electrically insulating filling compound. The antenna is relatively well protected by this means.

To anchor the filling compound as firmly as possible in the groove, it is provided in one embodiment of the above improvement that the groove broaden from the outward-facing side toward the center of the cutting roller.

In a further embodiment of the above improvement, it is provided that the groove have side walls implemented with elevations and depressions. Particularly good retention of the filling compound in the groove is achieved in this manner.

So that the transmission signals are radiated continuously, the antenna is implemented as an annular, closed antenna line.

In a further improvement, suited in particular for retrofitting a shield tunneling machine, the generator unit comprises a dynamo having permanent magnets mounted to a stationary member of the cutting roller and having an induction coil arrangement mounted to a member that rotates when the cutting roller is rotating.

To achieve reliable transmission of the transmission signals even under unfavorable conditions, it is provided in a further improvement that the receiving unit comprise a relay station by means of which the transmission signals can be routed receivably and wirelessly to a monitoring radio module.

Further suitable embodiments and advantages of the invention are discussed in the following description of embodiment examples provided with reference to the figures of the drawing.

Therein:

Figure 1:
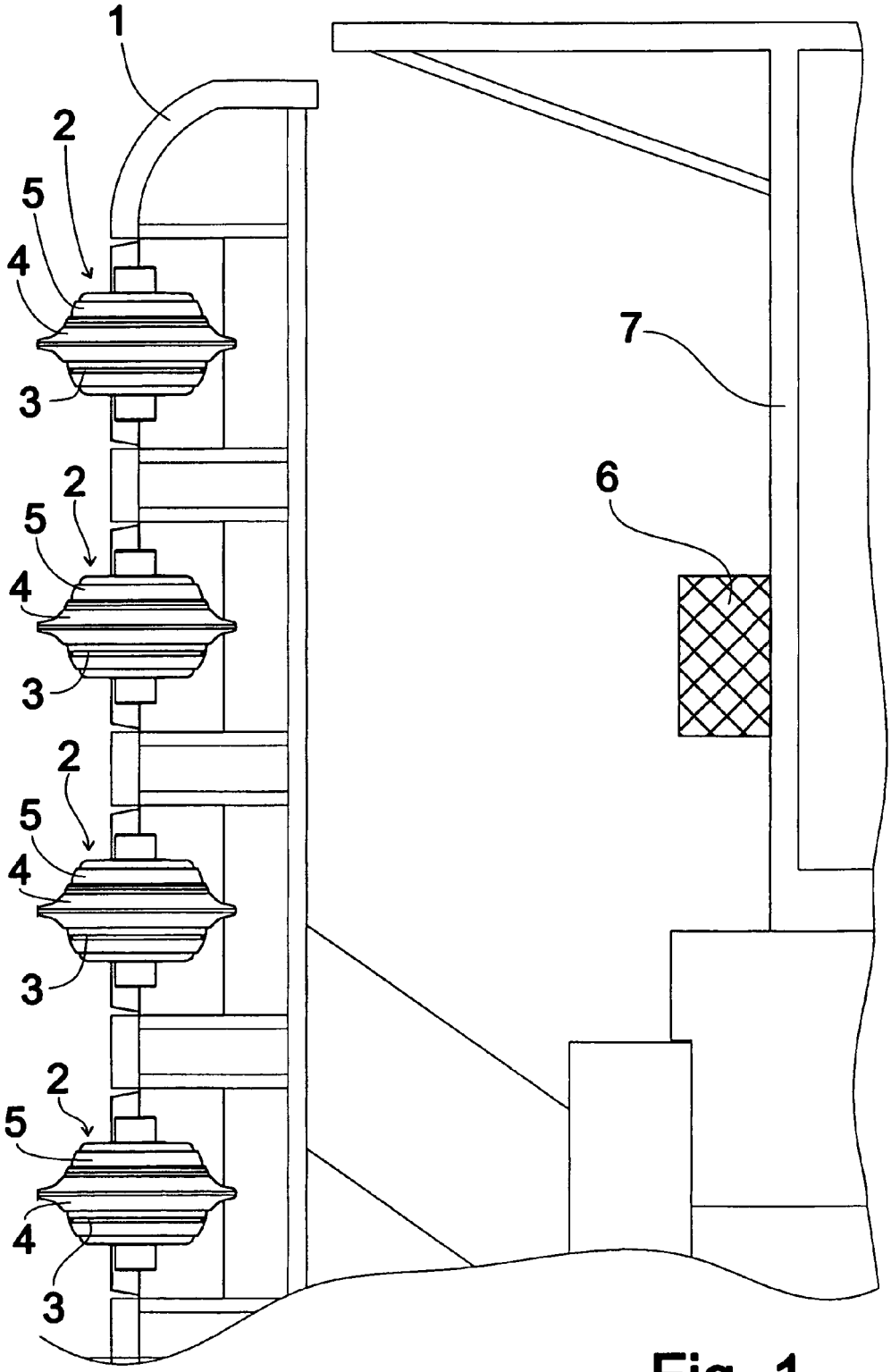
FIG. 1 is a partially cut-away side view of the forward-most region of the shield of a shield tunneling machine equipped with an arrangement according to the invention.

FIG. 1 is a partially cut-away side view of the forward-most region of the shield of a shield tunneling machine equipped with an arrangement according to the invention. The shield tunneling machine comprises a cutting wheel 1, a detail of which is shown, and which is equipped with a number of cutting rollers 2 belonging to the arrangement of the invention. The cutting rollers 2 are disposed concentrically about the axis of rotation of the cutting wheel 1 and serve, in a manner known per se, for excavation, especially in rock. In the embodiment example of FIG. 1, each cutting roller 2 is implemented with a circumferential groove 3 recessed into a base body 5 laterally to a hardened cutting body 4.

Further, FIG. 1 schematically illustrates a receiving unit 6 stationarily mounted to a beam 7 of the shield tunneling machine.

Figure 2:
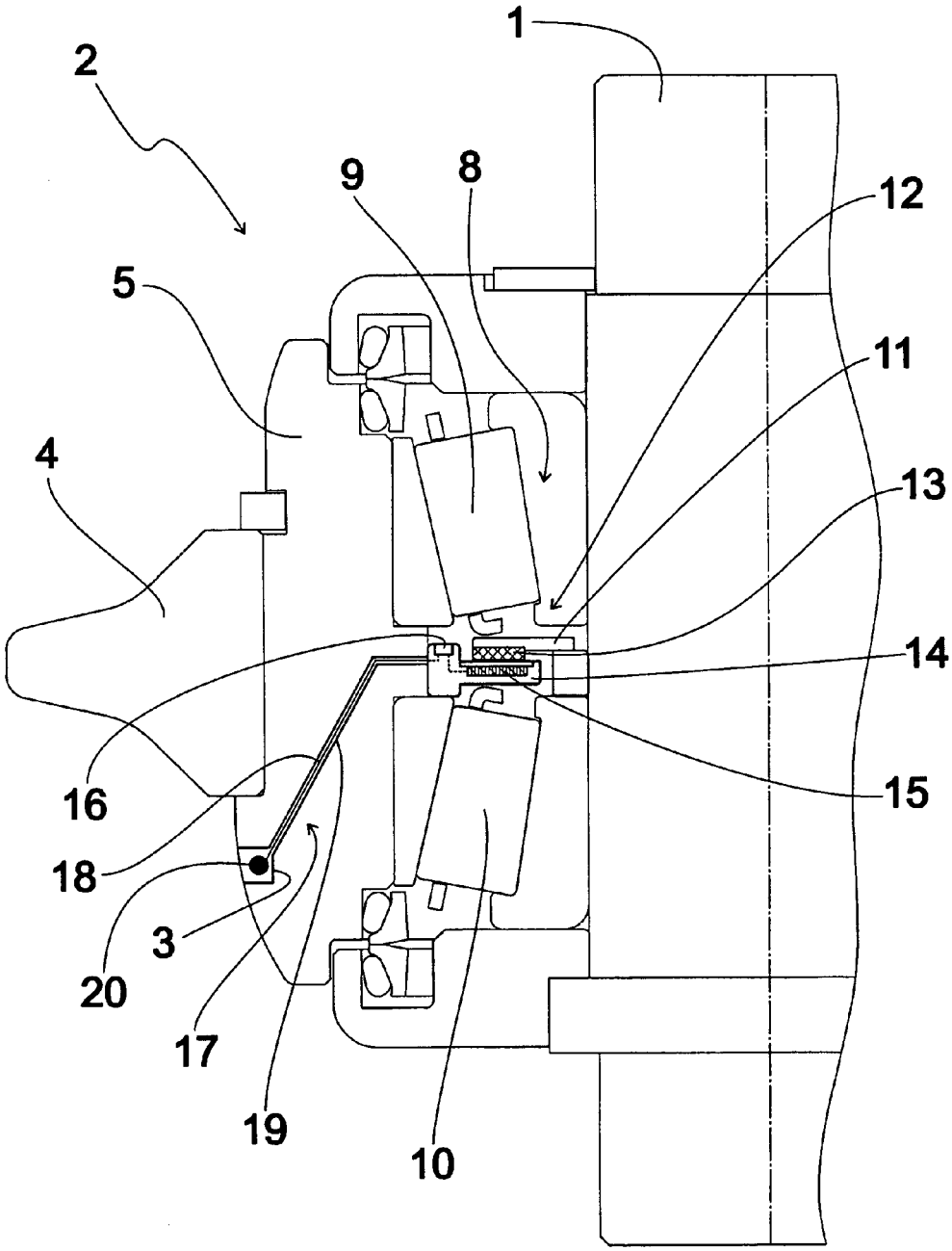
FIG. 2 is a partially cut-away side view, taken along line 2—2 of FIG. 1, of an arrangement according to the invention having one cutting roller, which comprises a generator unit, a signal-generating unit and an antenna unit.

FIG. 2 is a partially cut-away view of an arrangement according to the invention comprising a cutting roller 2 shown as an enlargement of the depiction of FIG. 1. Cutting roller 2 comprises a tapered roller bearing 8 provided with a first roll arrangement 9 and a second roll arrangement 10. Roll arrangements 9, 10 are disposed on both sides of a central plane of cutting roller 2. A magnet support ring 11 of a generator unit 12 is disposed in the region, preferably parallel to the central plane of cutting roller 2, and as a stationary member between roll arrangements 9, 10 in the embodiment example shown, with a number of a permanent magnets 13 mounted thereto. Magnet support ring 11 is connected to a stationary portion of cutting roller 2 that does not rotate when cutting roller 2 is used according to specifications.

Furthermore, in the embodiment example of FIG. 2, generator unit 12 is equipped with a coil support ring 14, which, like magnet support ring 11, is disposed in the region and parallel to the central plane of cutting roller 2. In the illustrated embodiment example, however, coil support ring 14, as a member that rotates when cutting roller 2 is rotating, is connected to the base body 5 of cutting roller 2 and comprises an induction coil arrangement 15 that is disposed opposite permanent magnets 13 and cooperates therewith on the principle of a dynamo to generate electrical energy.

FIG. 2 shows the induction coil arrangement 15 connected to a signal generating unit 16 that is structurally integrated into coil support ring 14 and is supplied with the electrical energy generated by generator unit 12 when cutting roller 2 is rotating. Signal generator unit 16 serves to generate transmission signals characteristic of a given cutting roller 2 when that cutting roller 2 is rotating. The transmission signals of different cutting rollers 2 can differ for example with regard to a characteristic transmission frequency for each cutting roller 2 in an analog implementation or a characteristic identification code for each cutting roller 2 in a digital implementation.

The arrangement illustrated as an example in FIG. 2 further comprises an antenna unit 17 connected via an electrical connecting line 18 to signal generating unit 16. Connecting line 18 is run through a connecting duct realized in the base body 5, which duct extends from coil support ring 14 to groove 3. Disposed in groove 3, as the antenna radiating the transmission signals, is an antenna line 20 that extends annularly over the full circumference of groove 3.

Figure 3:
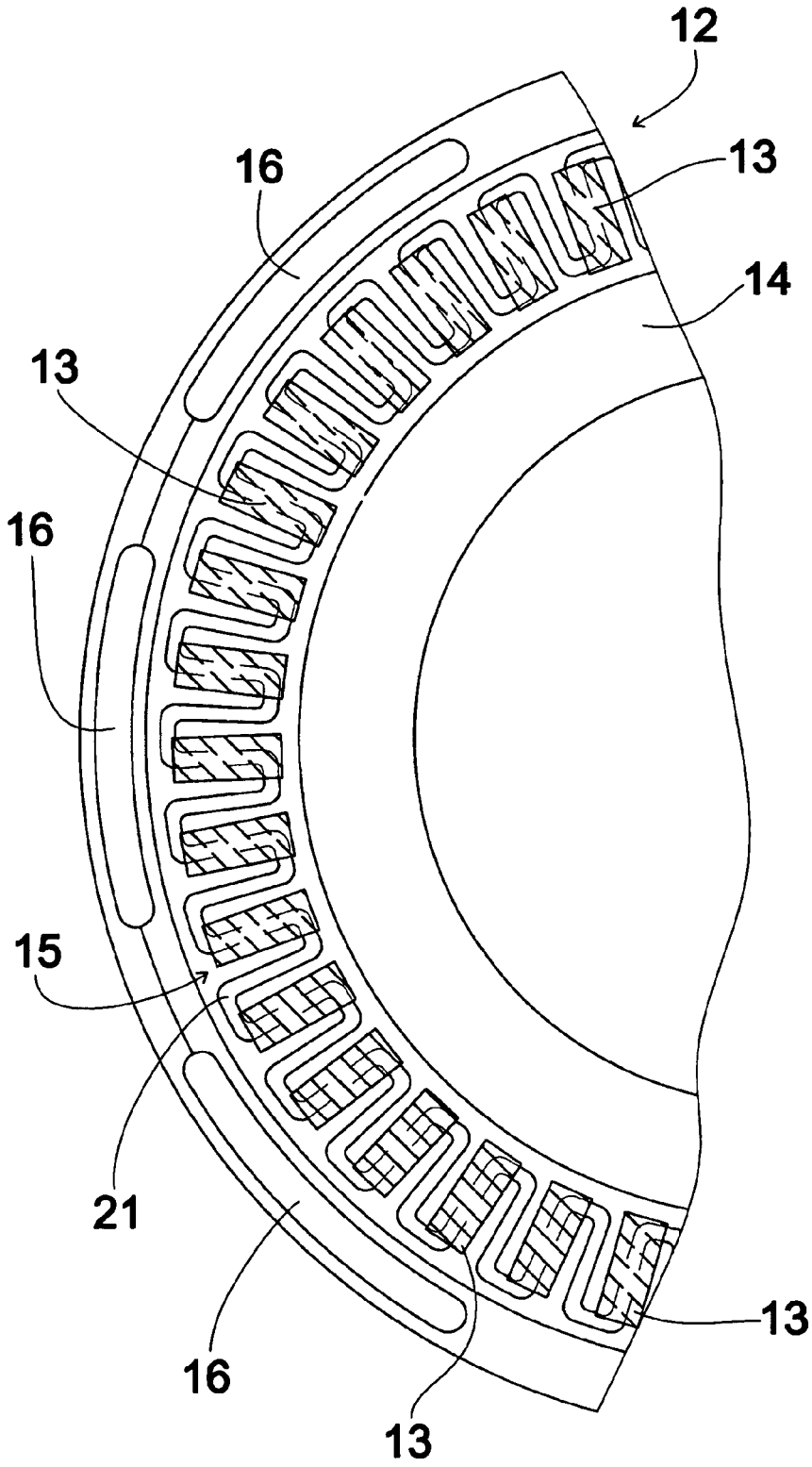
FIG. 3 is a side view, taken along line 3—3 of FIG. 2, of a portion of the generator unit.

FIG. 3 is a side view of a portion of the generator unit 12 of FIG. 2. From FIG. 3 it can be seen that the permanent magnets 13 mounted to magnet support ring 11 (not shown in FIG. 3) are regularly spaced and in order to generate electrical energy are disposed opposite a meander-like coil 21 that is part of induction coil arrangement 15 and is dimensioned to match the spacing of the permanent magnets 13.

Figure 4:
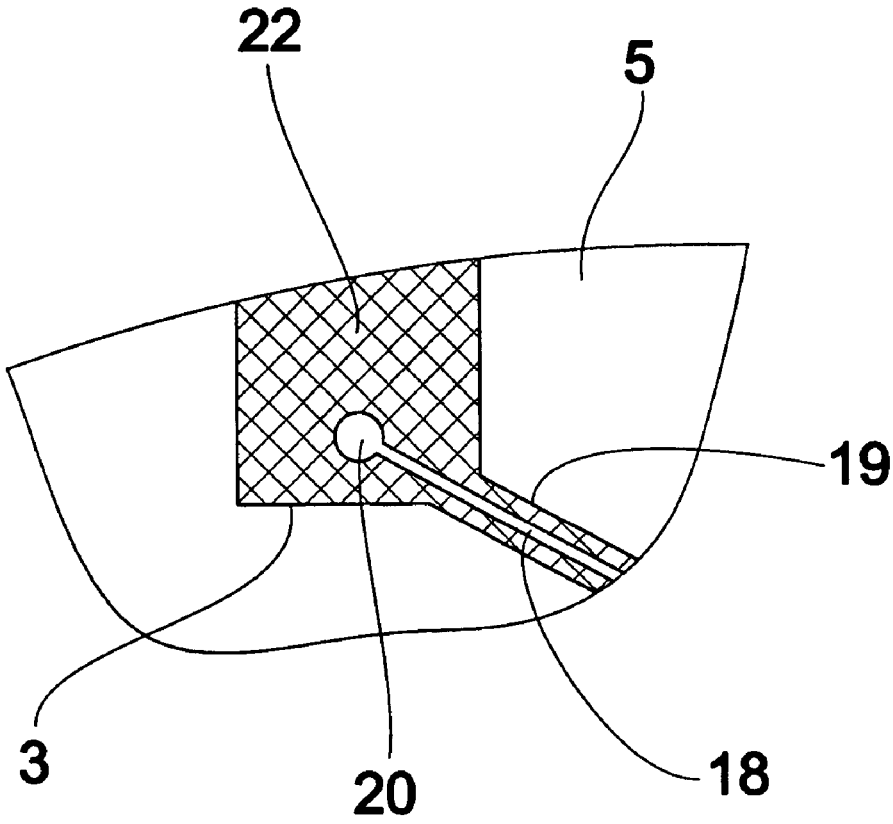
FIG. 4 is a cross section of the area shown by a dashed circle in FIG. 2, of the groove in which the antenna line of the antenna unit is disposed.
Figure 5:
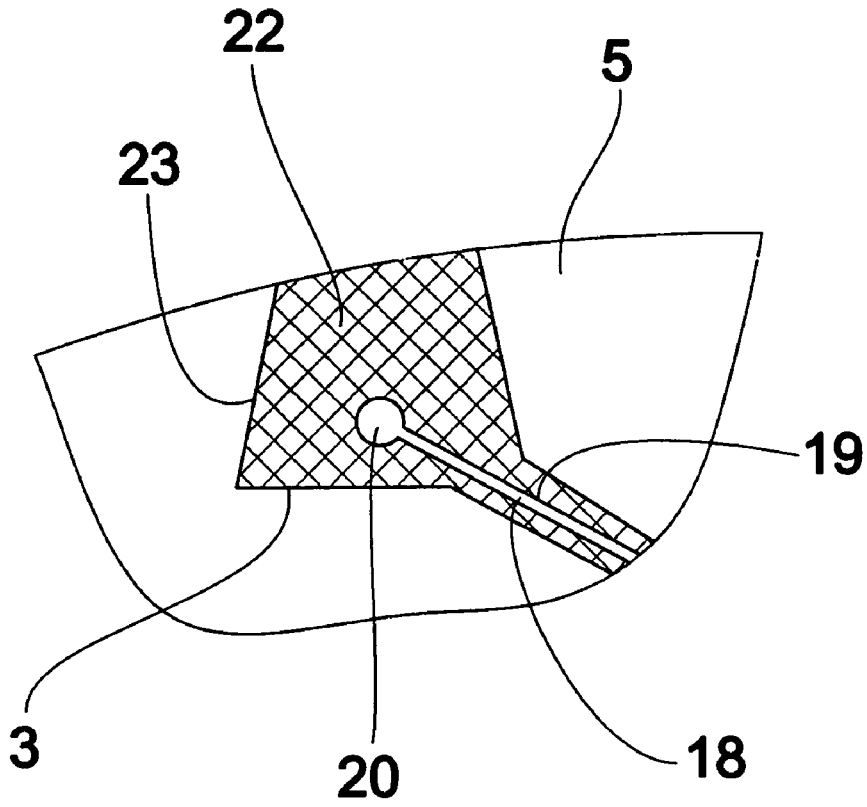
FIGS. 5 and 6 are cross sections of various embodiments, similar to FIG. 4, in which an antenna line of an antenna unit is disposed.
Figure 6:
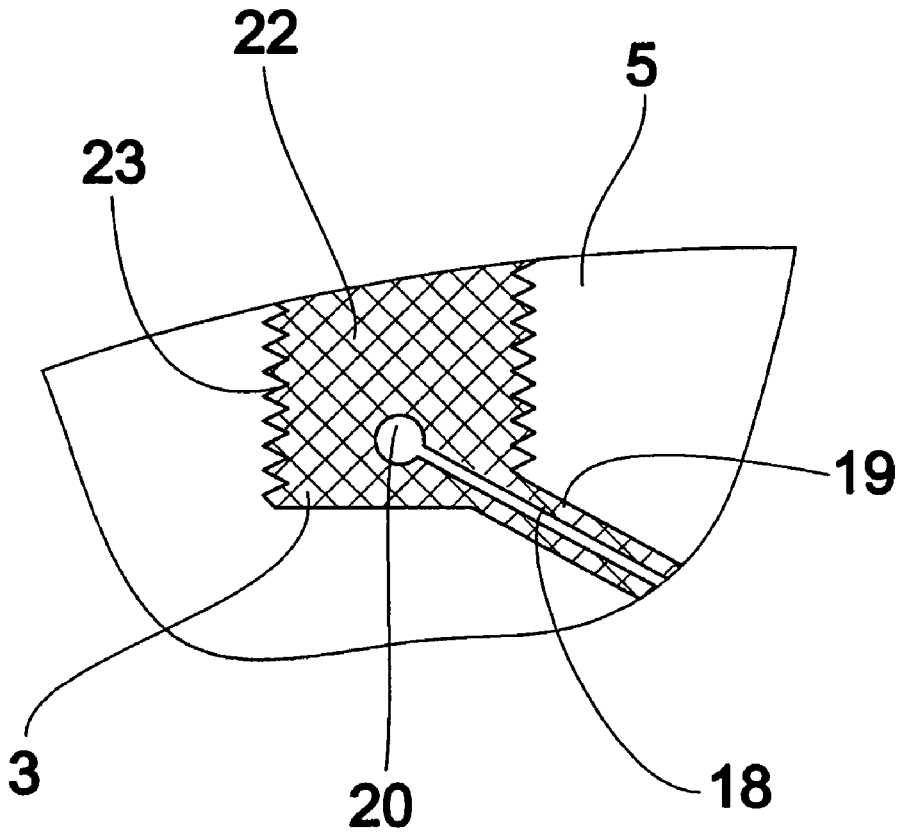

FIGS. 4 to 6 are cross sections of various embodiments of groove 3 in which an antenna line 20 or antenna unit 17 according to FIG. 2 is disposed.

In the embodiment of FIG. 4, the groove 3 has a substantially rectangular cross section and is filled with an electrically insulating filling compound 22.

In the embodiment of FIG. 5, to secure filling compound 22 the groove 3 is implemented in a trapezoid-like shape with smooth side walls 23 whose mutual spacing increases from the outside of base body 5 to the inside.

In the embodiment of FIG. 6, to secure filling compound 22 the groove 3 is implemented with side walls 23 provided with a number of elevations and depressions that interlock with the filling compound 22.

In the various embodiments, filling compound 22 is, for example, composed of a synthetic resin which, in cooperation with the walls of groove 3, withstands the extreme mechanical and thermal stresses for a longer time than the typical industrial service life of a cutting roller 2. It can therefore be assumed as a rule that when no transmission signals are present, generator unit 12 is not generating electrical energy for signal generating unit 16 because cutting roller 2 has stopped, but that antenna unit 17 is otherwise operative.

Figure 7:
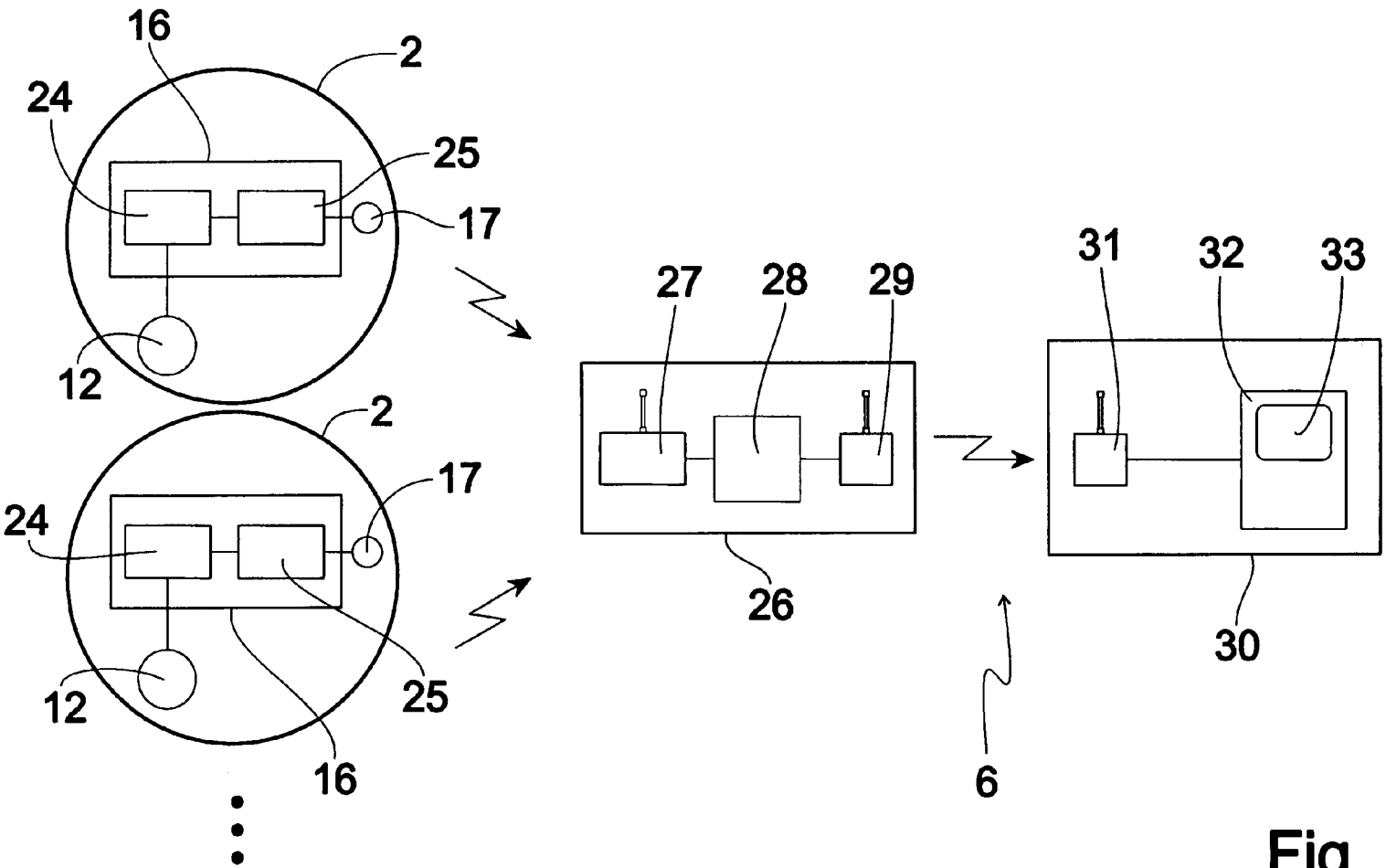
FIG. 7 is a block diagram of an embodiment example of an arrangement according to the invention comprising a relay station.

FIG. 7 is a block diagram particularly of an embodiment example of receiving unit 6 of an arrangement according to the invention. From FIG. 7 it can be seen that the signal generating units 16 of the cutting rollers 2 equipped with arrangements according to the invention each comprise a signal conditioning module 24 connected to generator unit 12 and a roller radio module 25 connected to signal conditioning module 24 and to antenna unit 17. Upon input of electrical energy from the generator unit 12, signal conditioning module 24 serves to generate presignals characteristic of the respective cutting roller 2, which presignals can be delivered to roller radio module 24 and converted by it into transmission signals that are transmissible by antenna unit 17.

The embodiment example illustrated in FIG. 7 includes a receiving unit 6 equipped with a relay station 26. Relay station 26 comprises a first relay radio module 27 able to receive the transmission signals transmitted by the antenna units 17 of the various cutting rollers 2. Assigned to first relay radio module 27 is a signal processing module 28 by means of which the transmission signals received by first relay radio module 27 can, in particular, be amplified. Disposed after signal processing module 28 is a second relay radio module 29 that serves to transmit the transmission signals processed by signal processing module 28.

In the embodiment example of FIG. 7, receiving unit 6 further comprises a monitoring station 30, disposed for example in a control booth of the shield tunneling machine, and implemented with a monitoring radio module 31 and a monitoring-data processing module 32 disposed after monitoring radio module 31. Monitoring radio module 31 serves to receive the transmission signals transmitted by second relay radio module 29 and to feed monitoring-data processing module 32. Monitoring-data processing module 32 is able to interpret the received transmission signals assigned to a respective one of cutting rollers 2 in such a way that any stoppage of cutting rollers 2 equipped with the arrangements according to the invention, as manifested by the absence of assigned transmission signals, is indicated in a visually perceptible manner, for example in a display 33.

It will be appreciated from the above explanations that conventional shield tunneling machines can be retrofitted as needed with an arrangement according to the invention in a comparatively simple manner by replacing a number or all of the conventional cutting rollers with cutting rollers 2 according to the invention and installing the receiving unit 6.

It should further be noted that in embodiment examples not shown, the cutting rollers 2 according to the invention comprise sensors, for example for pressure and temperature, whose output signals can be modulated to the transmission signals by signal generating unit 16, receiving unit 6 being equipped to interpret the values, for example pressure and temperature values, detected by the sensors.

The invention claimed is:

1. An apparatus for detecting the state of rotation of cutting rollers of a shield tunneling machine, said machine having at least one cutting roller, said apparatus comprising:

a generator associated with said one cutting roller and adapted to generate electrical energy when said cutting roller rotates;

a signal-generator connected to said generator;

an antenna unit connected to said signal-generator;

said signal-generator adapted to generate transmission signals characteristic of the state of rotation of said one cutting roller;

said antenna unit including an antenna which is disposed over at least an outer circumferential portion of said one cutting roller and which is adapted for wireless transmission of said transmission signals; and a receiver adapted to receive and interpret said transmission signals concerning the state of rotation of said cutting roller.

2. The apparatus of claim 1 wherein said cutting roller includes a base body, a groove located in said body, a mechanically and thermally resistant, electrically insulating filling compound disposed in said groove, said antenna embedded in said filling compound.

3. The apparatus of claim 2 wherein said groove broadens from an outward-facing side of said cutting roller toward the center of said cutting roller.

4. The apparatus of claim 2 wherein said groove comprises side walls implemented with elevations and depressions that interlock with said filling compound.

5. The apparatus of claim 2 wherein said antenna comprises an annular, closed antenna line.

6. The apparatus of claim 1 wherein said one cutting roller includes a stationary member and a movable coil support ring, said coil support ring rotating when said one cutting roller rotates, said generator comprising a dynamo having permanent magnets mounted to said stationary member and an induction coil arrangement mounted to said coil support ring.

7. The apparatus of claim 1 wherein said receiver comprises a relay station for receiving said transmission signals and for wirelessly routing said signals to a monitoring radio.

8. The apparatus of claim 1 further including a plurality of cutting rollers and associated generators, signal-generators, and antenna units, said receiver adapted to receive and interpret transmission signals from said signal-generators concerning the state of rotation of said respective rollers.

* * * * *